US010518957B2

(12) United States Patent
Perus

(10) Patent No.: US 10,518,957 B2
(45) Date of Patent: Dec. 31, 2019

(54) MULTI-POUCH WITH DISPENSER

(71) Applicant: Priyason Jonathon Perus, Meridian, ID (US)

(72) Inventor: Priyason Jonathon Perus, Meridian, ID (US)

( * ) Notice: Subject to any disclaimer, the term of this patent is extended or adjusted under 35 U.S.C. 154(b) by 0 days.

(21) Appl. No.: 16/112,531

(22) Filed: Aug. 24, 2018

(65) Prior Publication Data

US 2019/0256275 A1 Aug. 22, 2019

Related U.S. Application Data

(60) Provisional application No. 62/633,495, filed on Feb. 21, 2018.

(51) Int. Cl.
*B65D 81/32* (2006.01)

(52) U.S. Cl.
CPC ..... *B65D 81/3261* (2013.01)

(58) Field of Classification Search
CPC ..... B65D 81/3261; B65D 81/325; B65D 81/3255; B65D 81/3266
See application file for complete search history.

(56) References Cited

U.S. PATENT DOCUMENTS 3,323,682 A * 6/1967 Creighton, Jr. ... B05C 17/00513 222/94
3,439,827 A * 4/1969 Marland ..... B65D 83/005 215/12.1
3,722,561 A * 3/1973 O'Leary ..... B65B 67/1238 141/316
6,245,367 B1 * 6/2001 Galomb ..... B65D 51/247 206/541
2002/0166779 A1 * 11/2002 Etesse ..... B65D 75/008 206/219
2003/0019883 A1 * 1/2003 De Laforcade ..... A45D 19/02 222/1
2006/0193541 A1 * 8/2006 Norcom ..... B65D 31/06 383/200
2006/0255062 A1 * 11/2006 Muenzenberger ... B65D 81/325 222/94
2008/0277310 A1 * 11/2008 Chacon ..... B65D 77/062 206/568

* cited by examiner

*Primary Examiner* — Corey N Skurdal

(74) *Attorney, Agent, or Firm* — Shaver & Swanson, LLP; Scott D. Swanson

(57) ABSTRACT

The present disclosure is directed to an apparatus and system for dispensing foods and liquids to be kept separate in a pouch, package or bag. The pouch has separate components within that separate components with a removable or openable divider between the components for combining the components. For example, a liquid component and a solid component can be kept separate in the packaging with a removable or openable barrier between the solid and liquid component. The packaging includes a base which supports the pouch, which is rollable or foldable into the base to provide a mechanism for adjusting the level of the material within the pouch in relation to an upper opening of the bag.

20 Claims, 11 Drawing Sheets

MULTI-POUCH WITH DISPENSER

PRIORITY/CROSS-REFERENCE TO RELATED APPLICATIONS

This application claims the benefit of U.S. Provisional Application No. 62/633,495, filed Feb. 21, 2018, the disclosure of which is incorporated by reference.

BACKGROUND OF THE INVENTION

A variety of bags and structures are known for holding a liquid and/or solid. However, the inventor is unaware of a mechanism that allows for a user to place a liquid or semisolid foodstuff in a pouch, to have the pouch maintain rigidity, and to allow the user to easily maintain the level of the liquid or semisolid foodstuff at an easily accessible to a user, preferable near an opening at the top of the pouch.

SUMMARY OF THE INVENTION

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is an apparatus for holding a foodstuff or beverage. The apparatus has a base. In a preferred embodiment the base is cylindrical. The base comprises an outer wall and an inner structure. In a preferred embodiment the inner structure is generally rounded in appearance having a concentric structure to the outer wall. The outer wall extends upward from a first end of the base to a second end of the base. The second end of the base is an open end. The inner structure extends from the first end of the base toward the second end of the base. The inner structure and outer wall are separated by an air gap that in a preferred embodiment surrounds the inner structure. The air gap is configured for the passage of an exterior wall of a pouch.

A pouch is configured for engagement with the base. In a preferred embodiment the pouch is configured to retain a foodstuff or beverage within the pouch. In a preferred embodiment the pouch has at least two compartments within the pouch. The pouch is configured to be supported on the base when the pouch is retaining a foodstuff or beverage. The pouch is defined by an exterior wall configured to retain a foodstuff or beverage. The exterior wall of the pouch is configured to roll or slide between the inner structure and the outer wall of the base such that as a user depletes foodstuff or beverage within the pouch, the pouch is configured to be rolled or slid through the air gap between the outer wall of the base and the inner projection and into the base. This allows the base to retain the level of foodstuff or beverage within the pouch to be near or proximate to an opening at the top of the pouch. This makes it easier for a user to eat, slurp, drink, spoon, or otherwise remove the foodstuff and/or beverage from within the pouch.

In a preferred embodiment the pouch is a presealed pouch that contains a liquid and/or foodstuff when it is provided to a user. The pouch can be a resealable pouch. In a preferred embodiment the exterior of the pouch has a gripping structure or mechanism, such as grip strips, on the exterior of the pouch to facilitate a user pushing the pouch into the base.

In a preferred embodiment compartments within the pouch are separated by a releasable membrane, with the term membrane being used to denote any structure that separates materials between compartments. Preferably this membrane is liquid impermeable, although membranes that are not liquid impermeable can be used to separate two solids. This allows for separate foodstuffs and/or beverages, for example cereal and milk, to be kept separate until a consumer is ready to consume the material. In a preferred embodiment the membrane has a resealable opening to make the pouch reusable. This can include a zip lock mechanism. Alternatively in single use pouches mechanisms such as a perforated membrane utilizing a pull tab to tear the membrane can be used.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature

BRIEF DESCRIPTION OF THE PREFERRED EMBODIMENTS

DETAILED DESCRIPTION OF THE PREFERRED EMBODIMENTS

Figure 1:
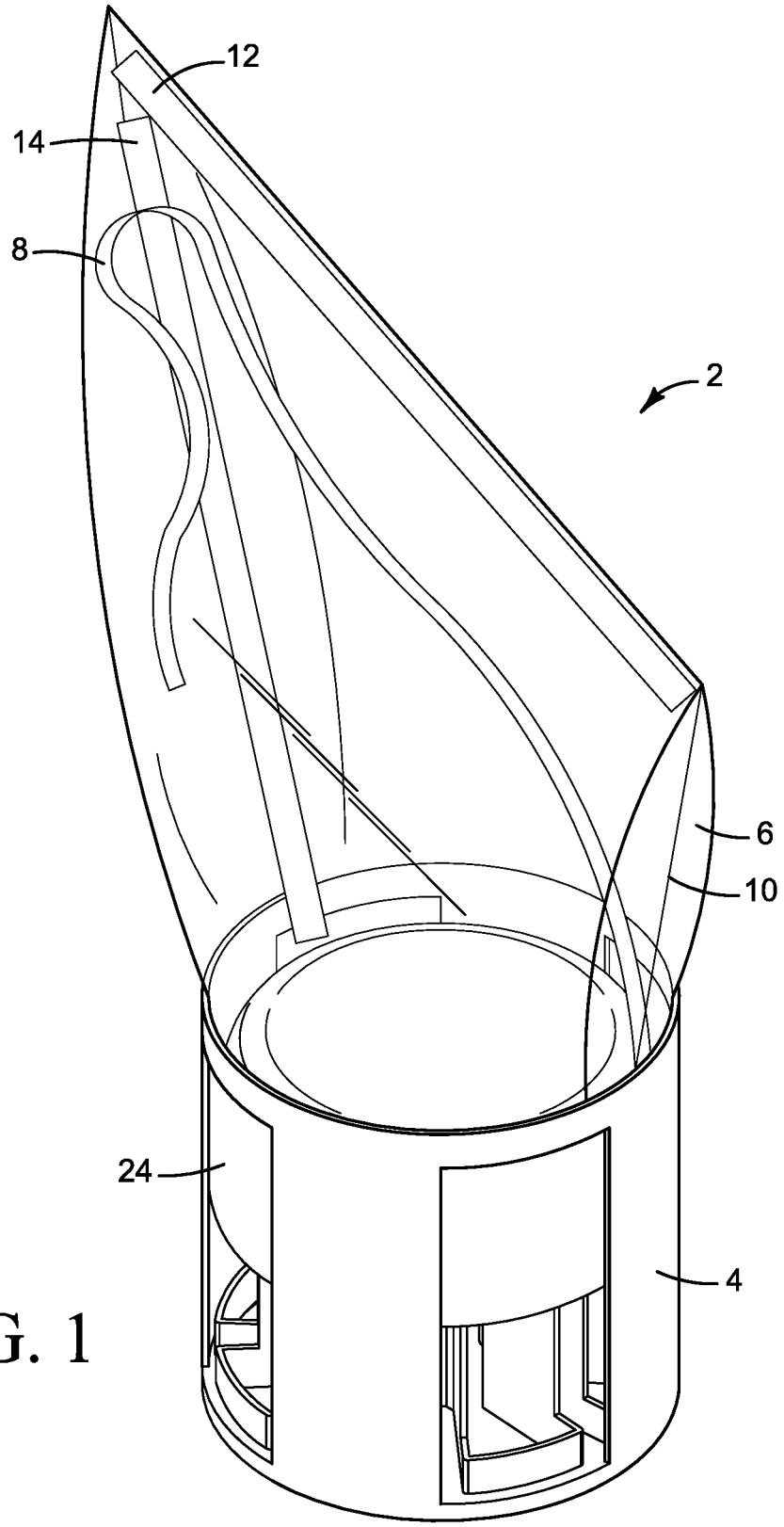
FIG. 1 depicts a perspective view of a preferred embodiment of a pouch member and a base member.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates a multi-compartment container 2 having a base 4 and a flexible pouch portion 6. The flexible pouch depicted is divided into two compartments 9, 11. The compartments are divided by a partition member 10. The partition member in a preferred embodiment is a flexible material, divided by a separable seal. The seal is connected to a pull-string or other force application device 8. In a preferred embodiment, the user opens a corner of the device 17, preferably utilizing the user's teeth. The corner can utilize a perforation to facilitate tearing or ripping of the corner. When the corner is removed, the user can then pull the pull-string 8, ripping the divider 10 at its base. In a preferred embodiment the divider has structural rigidity providing elements 12, 14 along the edges of the divider. This allows for a clean tear of the divider in full from the edges of the pouch. While in the depicted embodiment two compartments are shown in the pouch, further compartments could be utilized or a single compartment.

In a preferred embodiment, a user removes the corner of the pouch and drinks or spoons the materials from the pouch. As the pouch is emptied, the level of the liquid or other food stuff in the pouch will be lowered. As the level is lowered, the pouch can be rolled downward into the base. The base 4 provides an inner structure 24 which is rounded, upon which the pouch is rolled. This allows the pouch to be rolled, thus raising the relative level of the liquid or other foodstuff or matter to the opening of the pouch by lowering the pouch relative to the liquid or other foodstuff.

Figure 2:
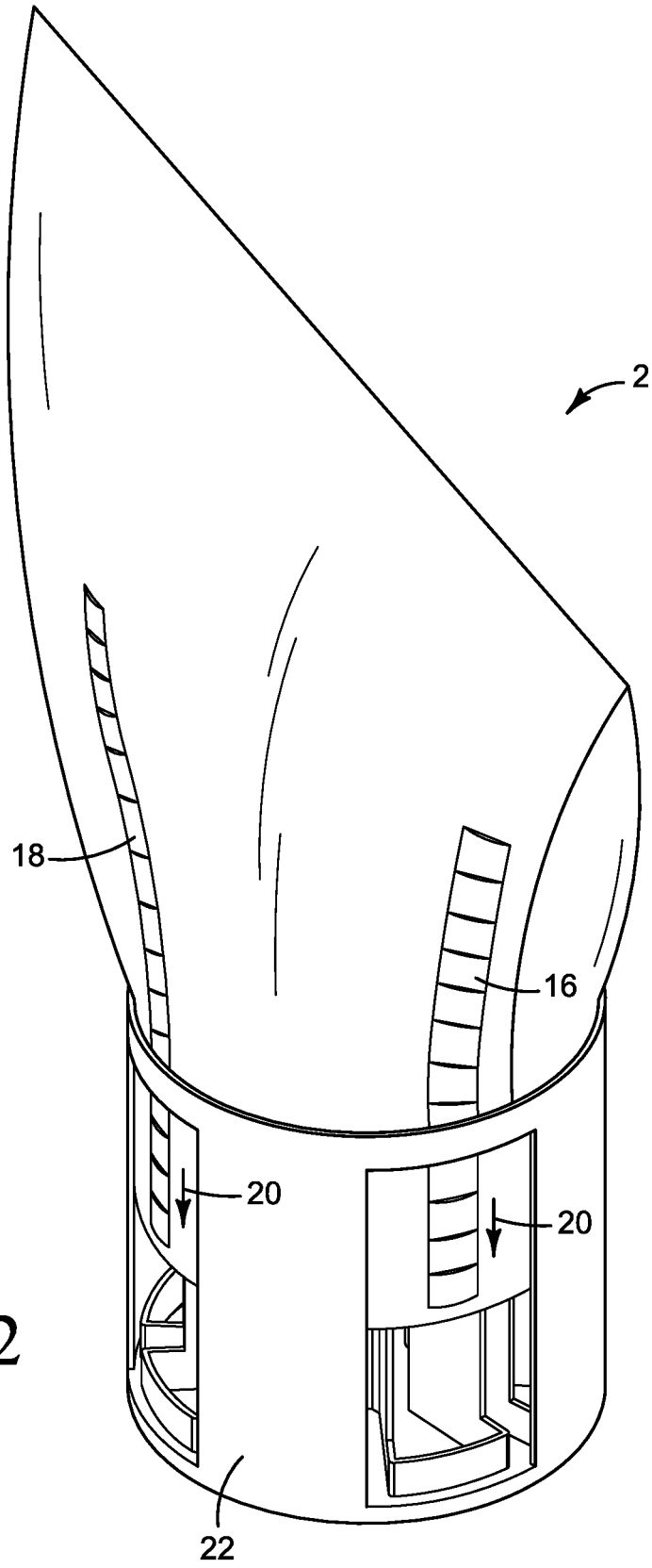
FIG. 2 depicts a perspective view of a preferred embodiment of pouch member being rolled into a base member.

FIG. 2 illustrates a preferred embodiment of a pouch 21, being rolled 20 downward onto the base 22. FIG. 2 depicts the pouch having grip strips 16, 18 which are raised areas of the pouch to facilitate a user's hand pushing down the pouch. Alternatively the grip strips can be adhered to the exterior of the pouch.

Figure 3:
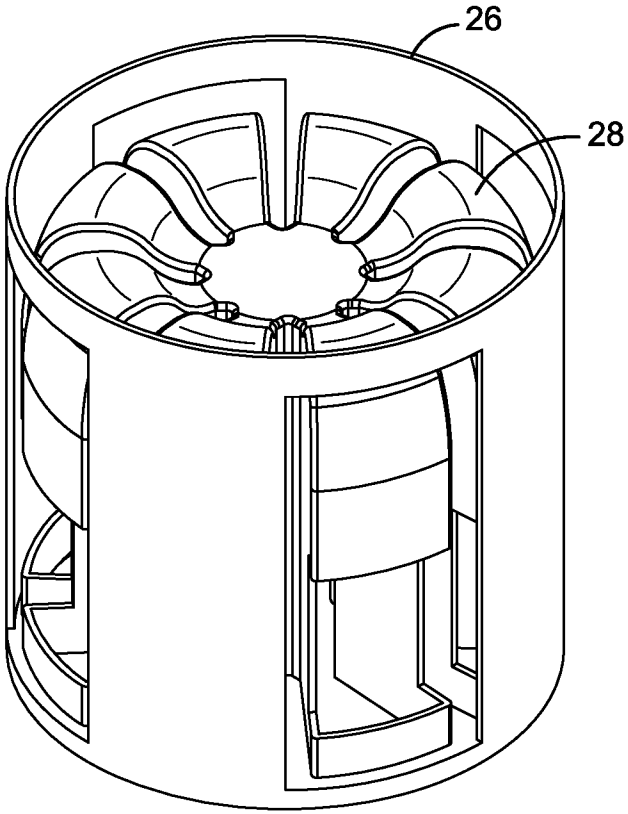
FIG. 3 depicts a top perspective view of a preferred embodiment of a base member.

FIG. 3 illustrates a top perspective view of a preferred embodiment of the base. The base has outer circumference or outer structure 26, and inner cylindrical section 28. Cylindrical section has rolled or curved edges to facilitate a pouch being rolled downward into an open space between the inner structure 28 and the outer structure 26. The inner structure 31, has opening 31 to facilitate the retention of pouch material as it is rolled downward. The base can be provided in a variety of shapes, including square or rectangular.

Figure 4:
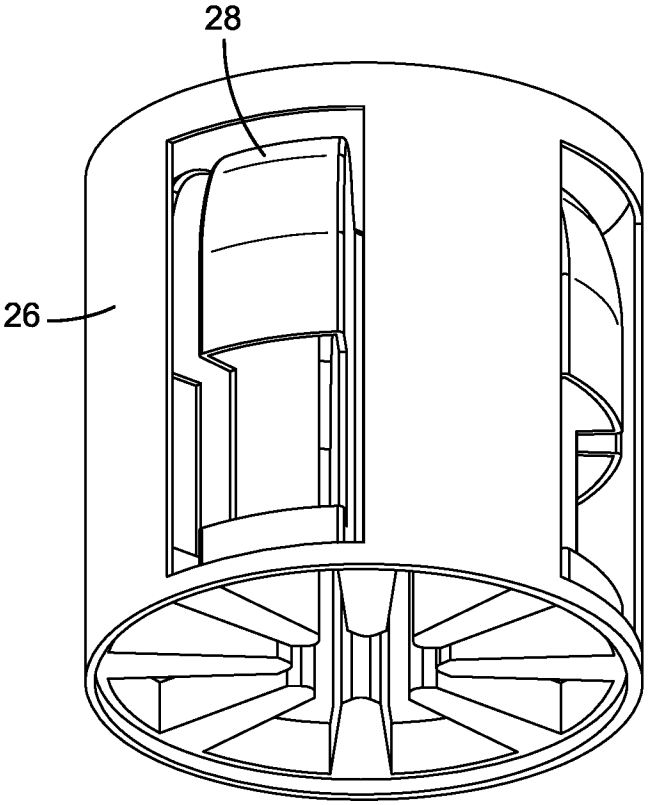
FIG. 4 depicts a bottom perspective view of a preferred embodiment of a base member.

FIG. 4 illustrates a bottom perspective view of a preferred embodiment of the base. The inner member 28 is connected to the outer member 26 at the base 33. This serves to provide a unitary unit, as well as to prevent a rolled pouch from proceeding past the bottom of the base. This allows the base to be set on a structure, such as a table.

Figure 5:
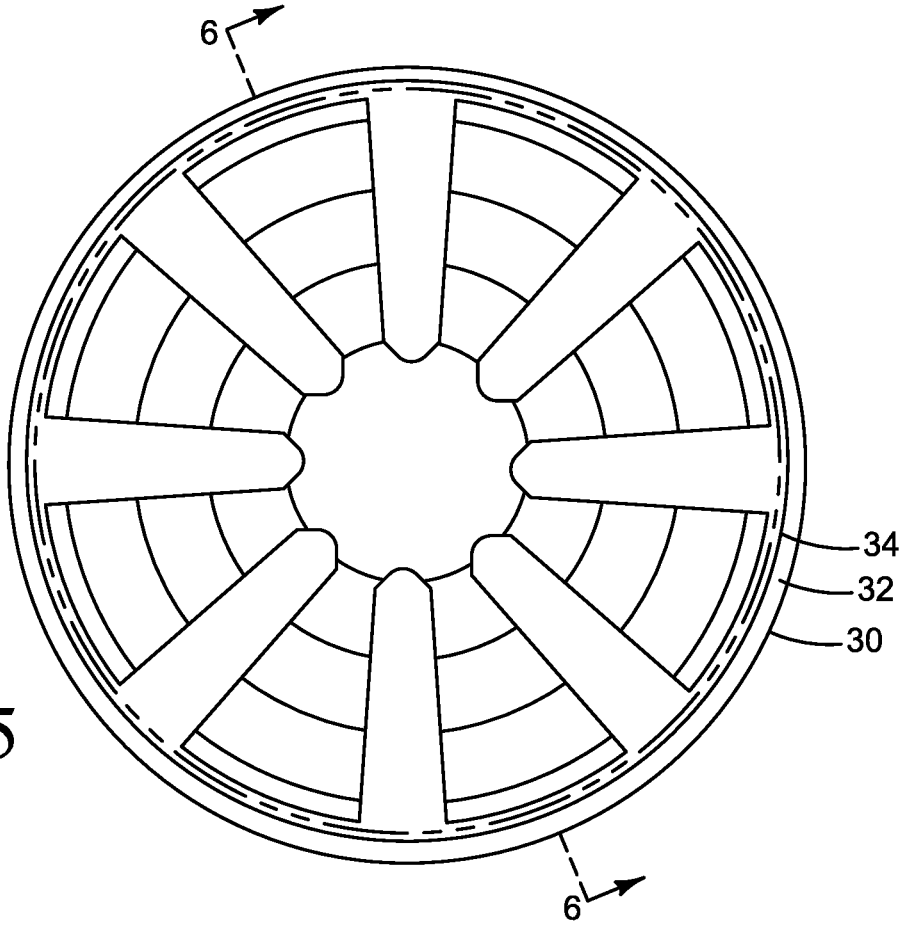
FIG. 5 depicts a bottom view of a preferred embodiment of a base member

FIG. 5 illustrates a bottom view of the base. FIG. 5 illustrates the outer circumference of the base from which the outer wall of the base extends, such that outer wall 32 is separated from the inner structure of the base by a space or air gap. This provides a space 34, into which the pouch can be rolled. FIG. 5 also illustrates a cross-sectional 6 of FIG. 6.

Figure 6:
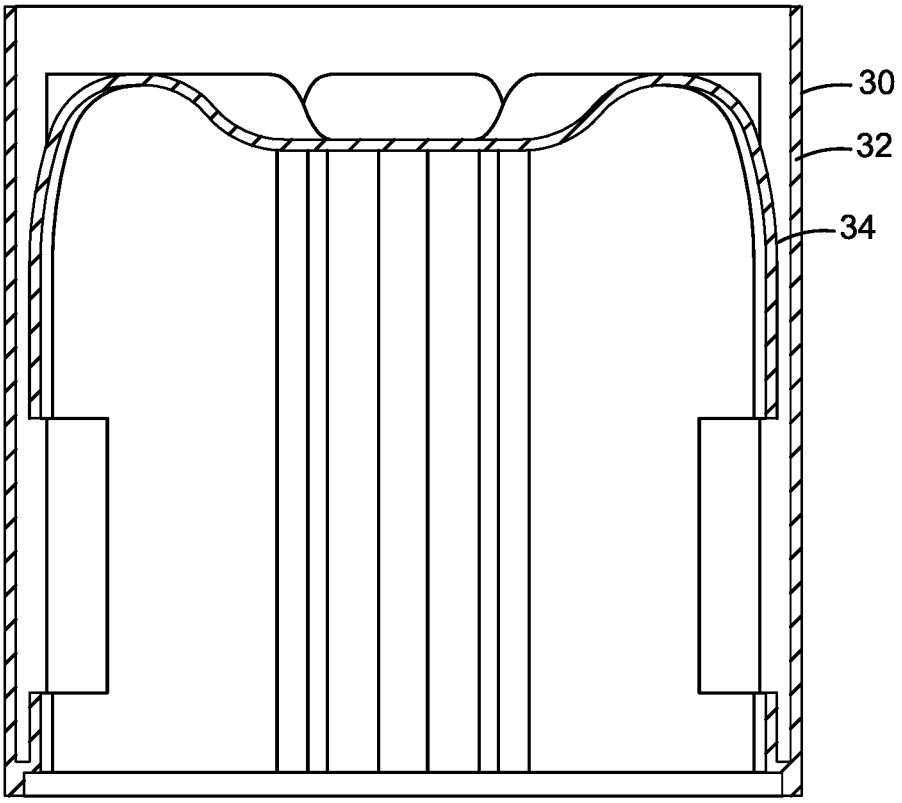
FIG. 6 depicts a cross-sectional view along cross-sectional line 6 of FIG. 5.

FIG. 6 illustrates cross-sectional along the line 6 of FIG. 5. FIG. 6 depicts the outer section of the base 111, separated from the inner surface of the inner structure 113. Air space or gap 115 is provided for the rolling down of the pouch material. Opening 117 is provided for the retention and storage of pouch material that has been rolled downward.

Figures 7, 8, 9:
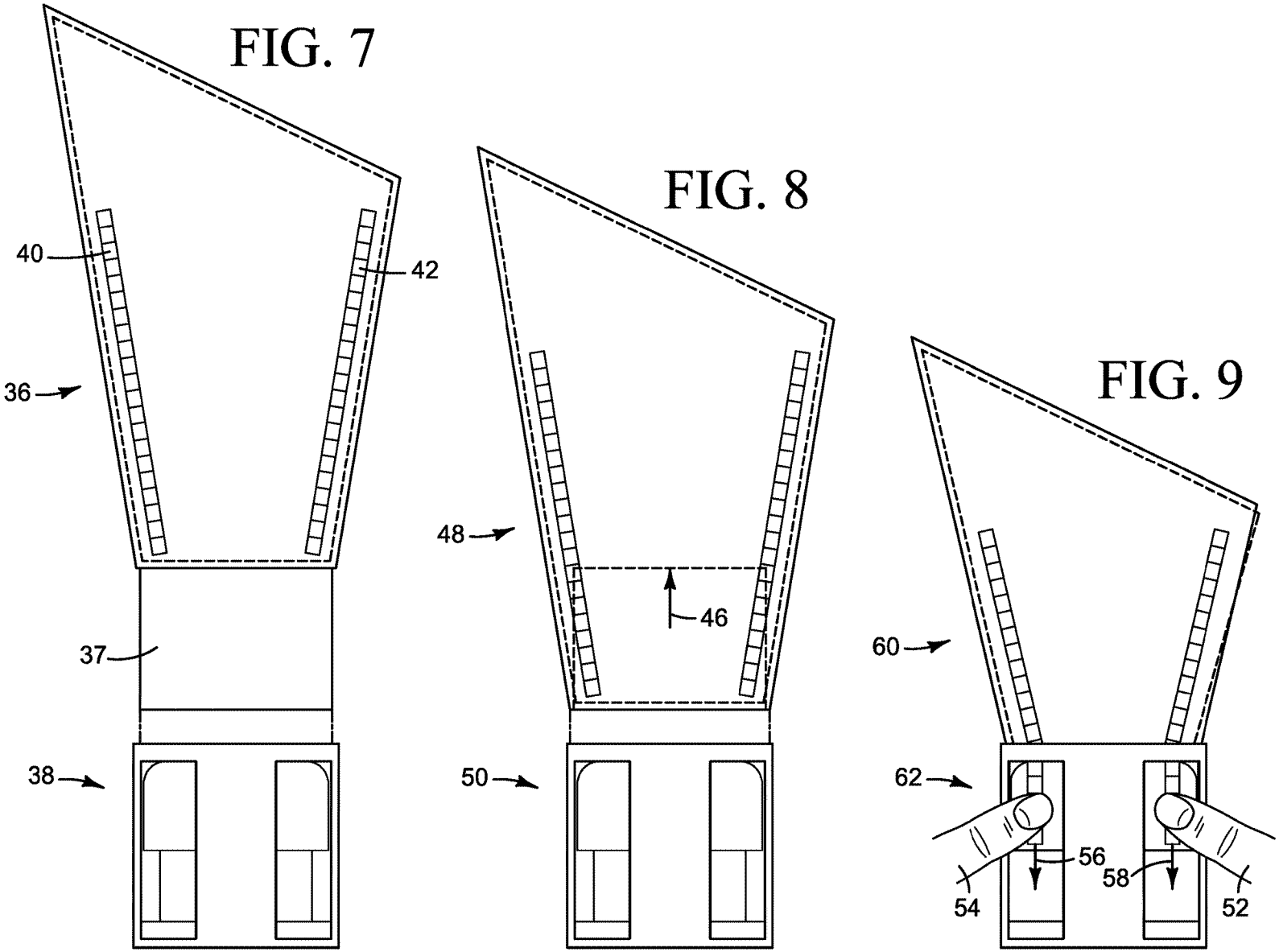
FIG. 7 depicts a first step of a pouch being rolled onto a base.
FIG. 8 depicts a second step of a pouch being rolled onto a base member.
FIG. 9 depicts a user utilizing his or her fingers to roll a pouch member onto a base.

FIGS. 7 through 9 illustrate the process by which the pouch is rolled downward onto the base. FIG. 7 illustrates a first position on which the pouch 36 is placed onto a base 38. The pouch has a base area 37 that can be pushed upward or supported by the inner projection 46. Alternatively the base area can be preformed to provide structural rigidity to the pouch. This provides structural rigidity to the pouch, as illustrated in FIG. 8. Grip strips 40, 42 can be utilized by a user to roll or depress the pouch into the base 38.

FIG. 8 illustrates a subsequent step from FIG. 7, in utilizing the apparatus. The bottom of the pouch is inflated upward 46. The pouch has been placed onto the base 50. The pouch 48 is then rolled downward as illustrated in FIG. 9. A user's fingers 54, 52, utilize the grip strips to push the pouch downward 56, 58. This serves to shorten the pouch 60, by retracting or rolling the pouch onto the base 62.

Figure 10:
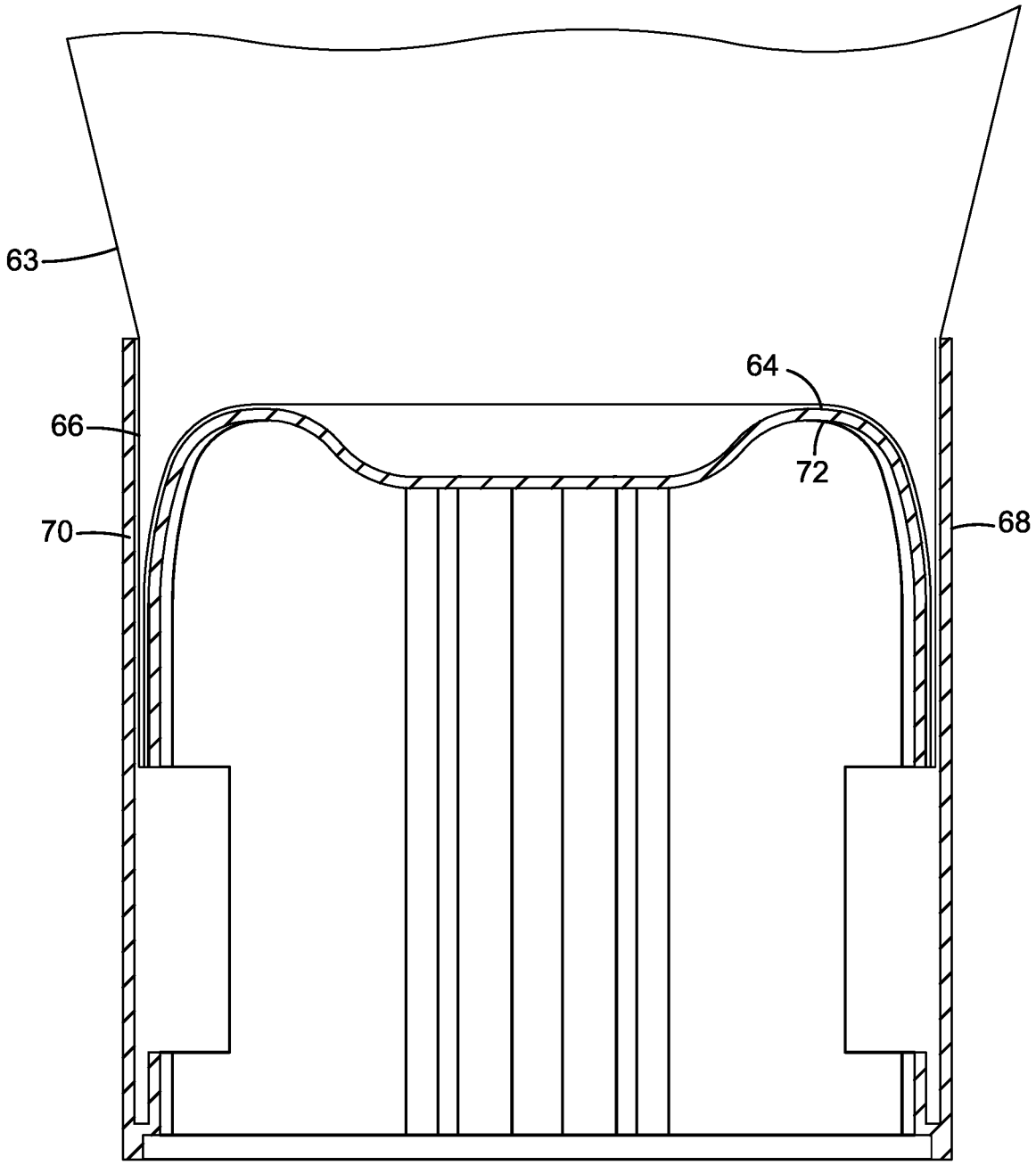
FIG. 10 depicts a preferred embodiment of the interaction between a pouch and a base member.

FIG. 10 illustrates embodiment of the base 68, with a pouch 63 residing on the base. The pouch 63 is positioned within the open area separating the outer section of the base 70, from the inner section of the base 72. The pouch protrudes downward into the air space or void between the outer section of the base and the inner section of the base. The bottom of the pouch 64 is positioned on the top section 72, of the inner base.

Figure 11:
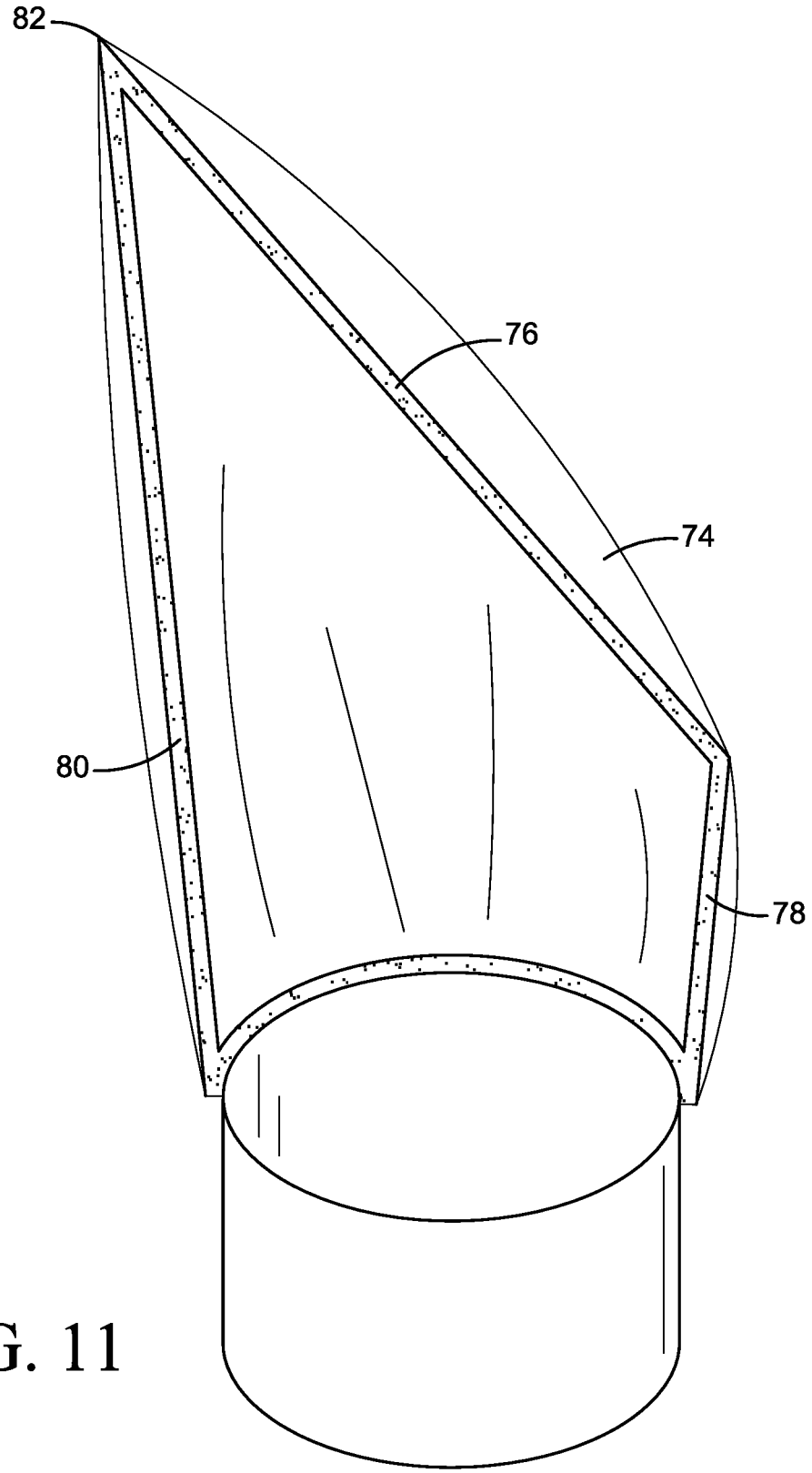
FIG. 11 depicts a preferred embodiment of the skeletal or scaffolding system of a membrane or separator of a pouch.

FIG. 11 illustrates an embodiment of the pouch utilizing an membrane or inner divider having a skeleton or frame between compartments of the pouch 74. The corner 82 of the pouch is the preferred location at which a user access materials within the pouch. The scaffolding or skeleton of the pouch membrane is configured to be torn off. In a preferred embodiment the scaffolding or skeleton is present at the joinder of the membrane to the exterior of the pouch. This allows the membrane to be torn or removed from the pouch without leaving any remnant membrane materials, such as plastic, within the pouch.

In a preferred embodiment the membrane or separator provides a liquid impermeable separation between the compartments of the pouch. This allows for different liquids or different solids, or a liquid and a solid to be maintained in separate compartments without mixing. When the user desires to mix the materials, the user removes the membrane by pulling on the pull-string depicted in FIG. 1 causing the membrane to tear away from the outer pouch. Alternatively a resealable mechanism can be provided to allow for consumers to place a variety of materials in the pouch and to reuse the pouch. A resealable mechanism can be utilized to allow for material to pass between the divider or at the top or end of the pouch to allow for a consumer to seal or reseal the pouch.

Figure 12:
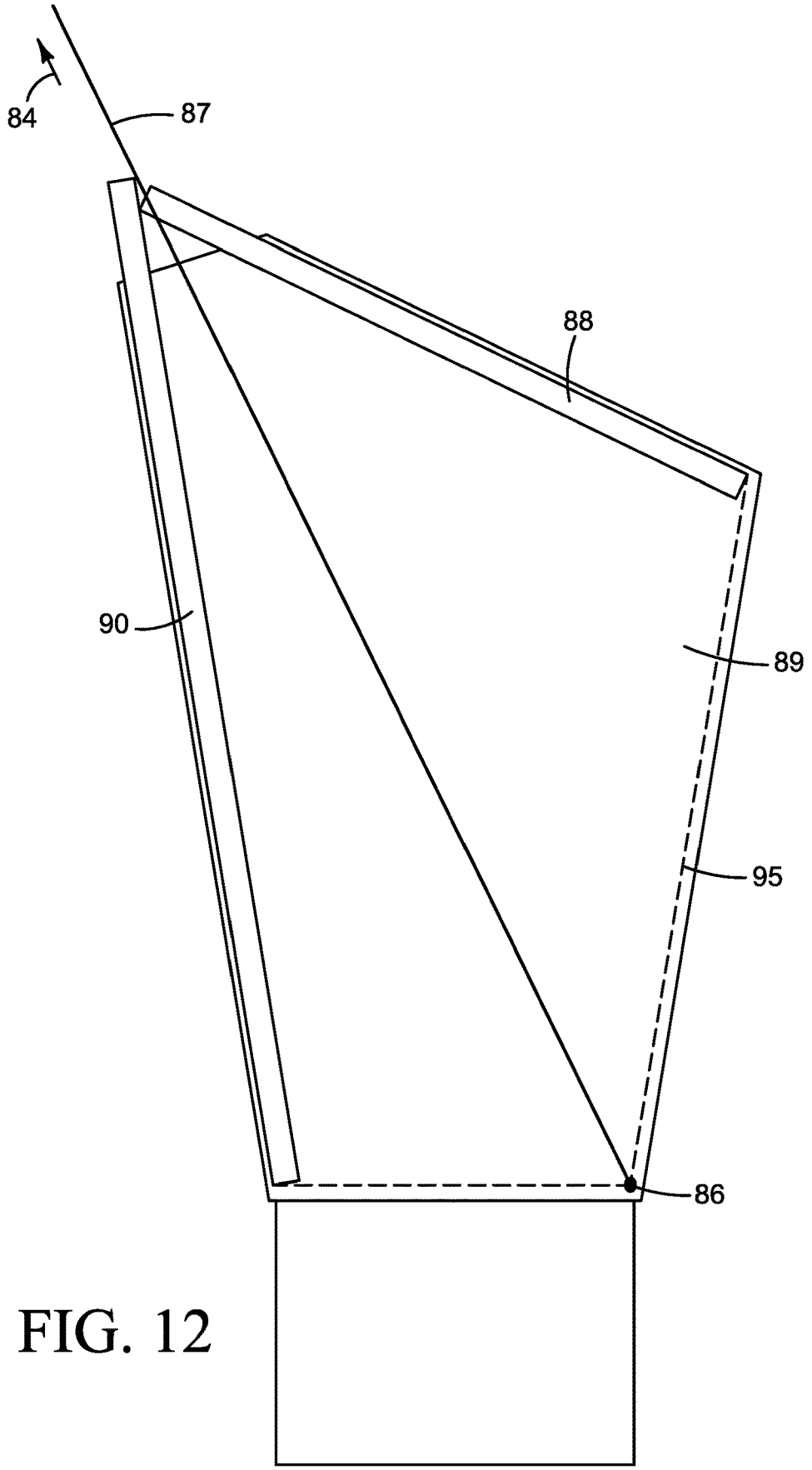
FIG. 12 depicts a preferred embodiment of the mechanism of separation of the internal membrane from a pouch.

FIG. 12 depicts a preferred embodiment of the inner working of the membrane. The membrane 89 is positioned within the pouch. To remove the membrane, a user applies force 84 to a pull-tab or similar object. The force pulls at first corner 86 of the membrane. This causes a tear to begin and to travel apart along perforated edges of the membrane attachment to the outer pouch 92, 94. The membrane then pulls at the scaffolding or tear strips 90, 88. The scaffolding or tear strips 90, 88, provide a rigid tear point provided to prevent any material of the membrane from being left attached to the outer pouch. The user then can drink, slurp, or otherwise eat the material from the pouch via the torn off corner 81. Alternatively a resealable mechanism, such as a zip-lock closure can be utilized.

Figure 13:
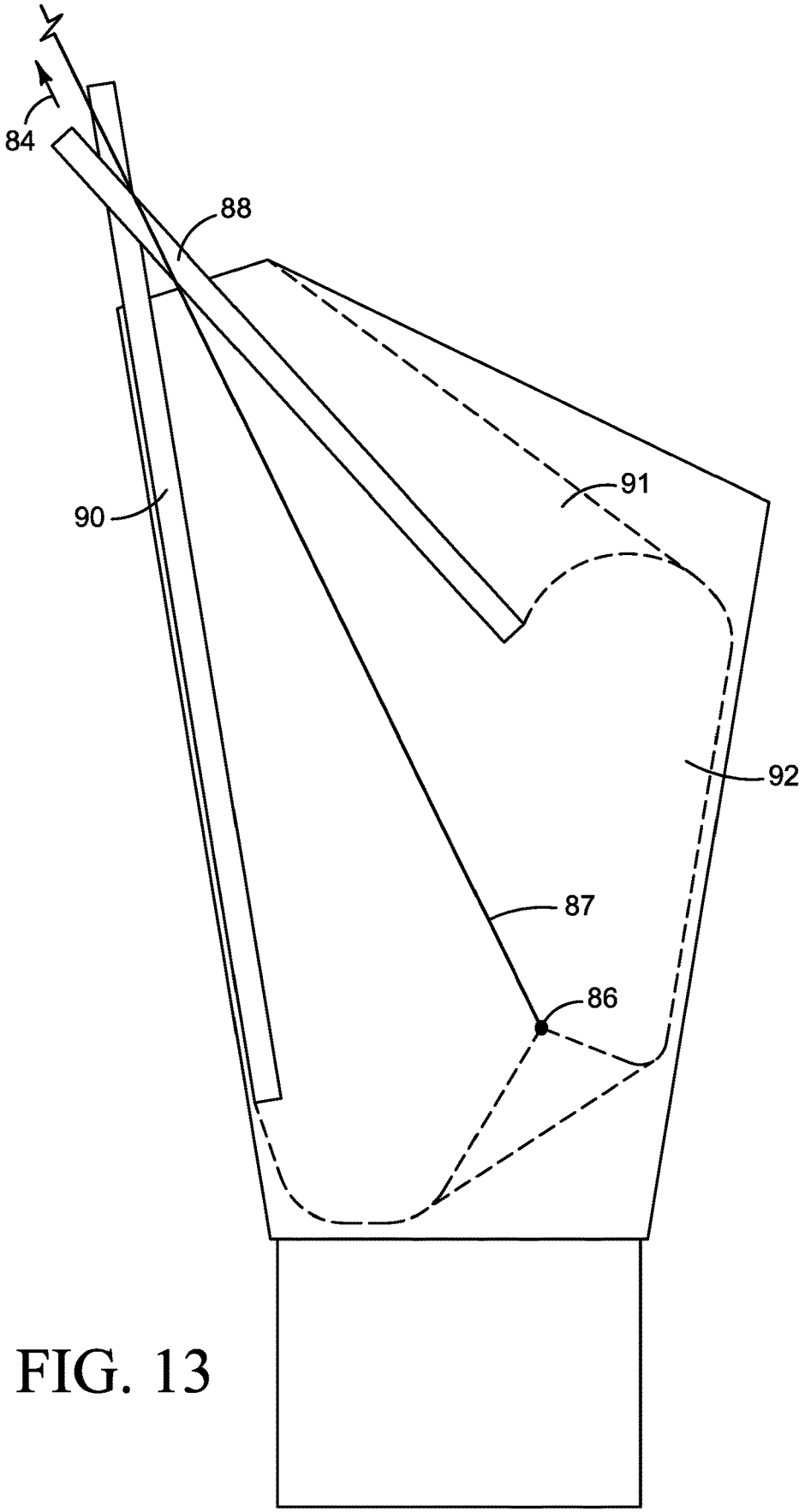
FIG. 13 depicts a preferred embodiment of a membrane separator being removed from a pouch.

FIG. 13 depicts a similar alternative embodiment of the removal of the membrane. As the corner of the membrane 86 is being pulled, the scaffolding edges 89, 91, are also pulled causing the membrane to be removed from the outer pouch.

Figure 14:
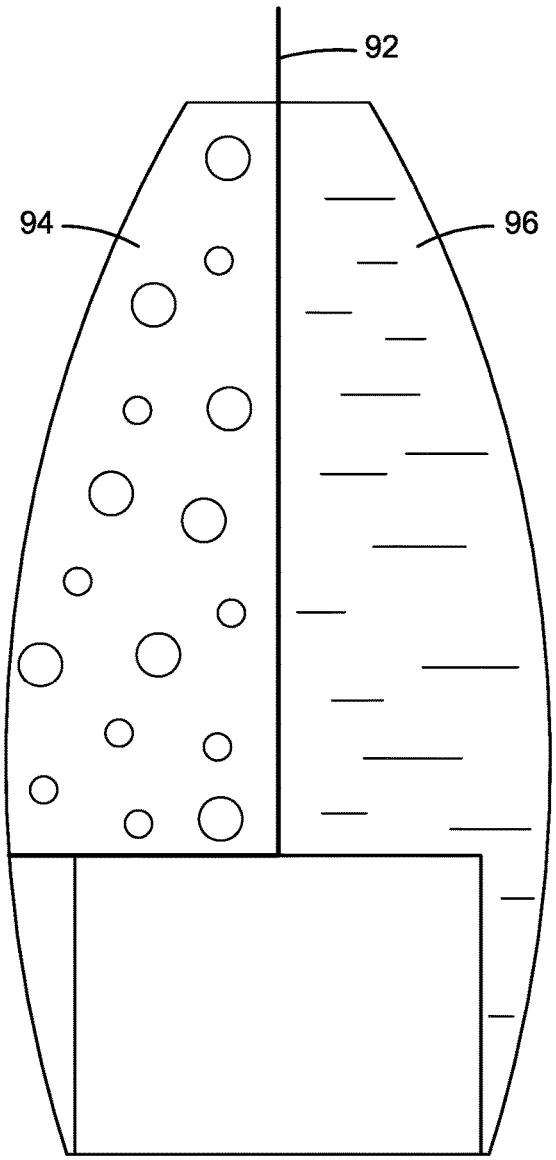
FIG. 14 depicts a preferred embodiment of two materials being separated by a membrane within the pouch.
Figure 15:
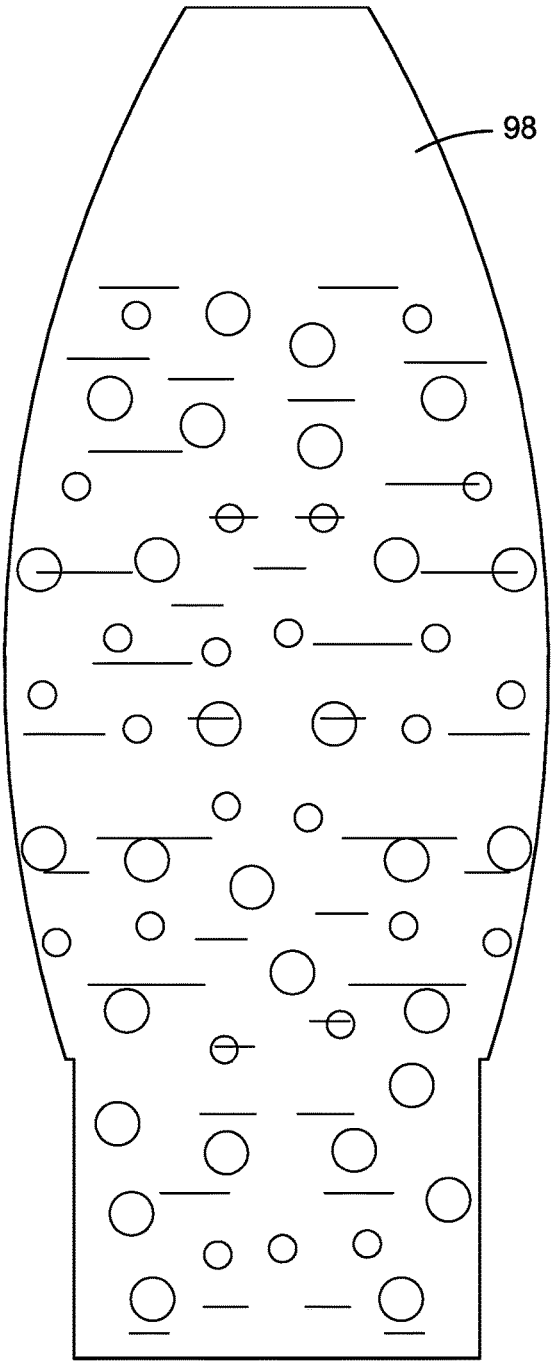
FIG. 15 depicts a preferred embodiment of the pouch having a membrane removed thus the mixture of the two materials of FIG. 14.

FIGS. 14 and 15 depict the inner mixing of a solid 94 and a liquid 96, upon removal of the membrane 92. FIG. 15 depicts the aftermath of the removal of the membrane, illustrating a mixture of the liquid and the solid 98.

Figure 16:
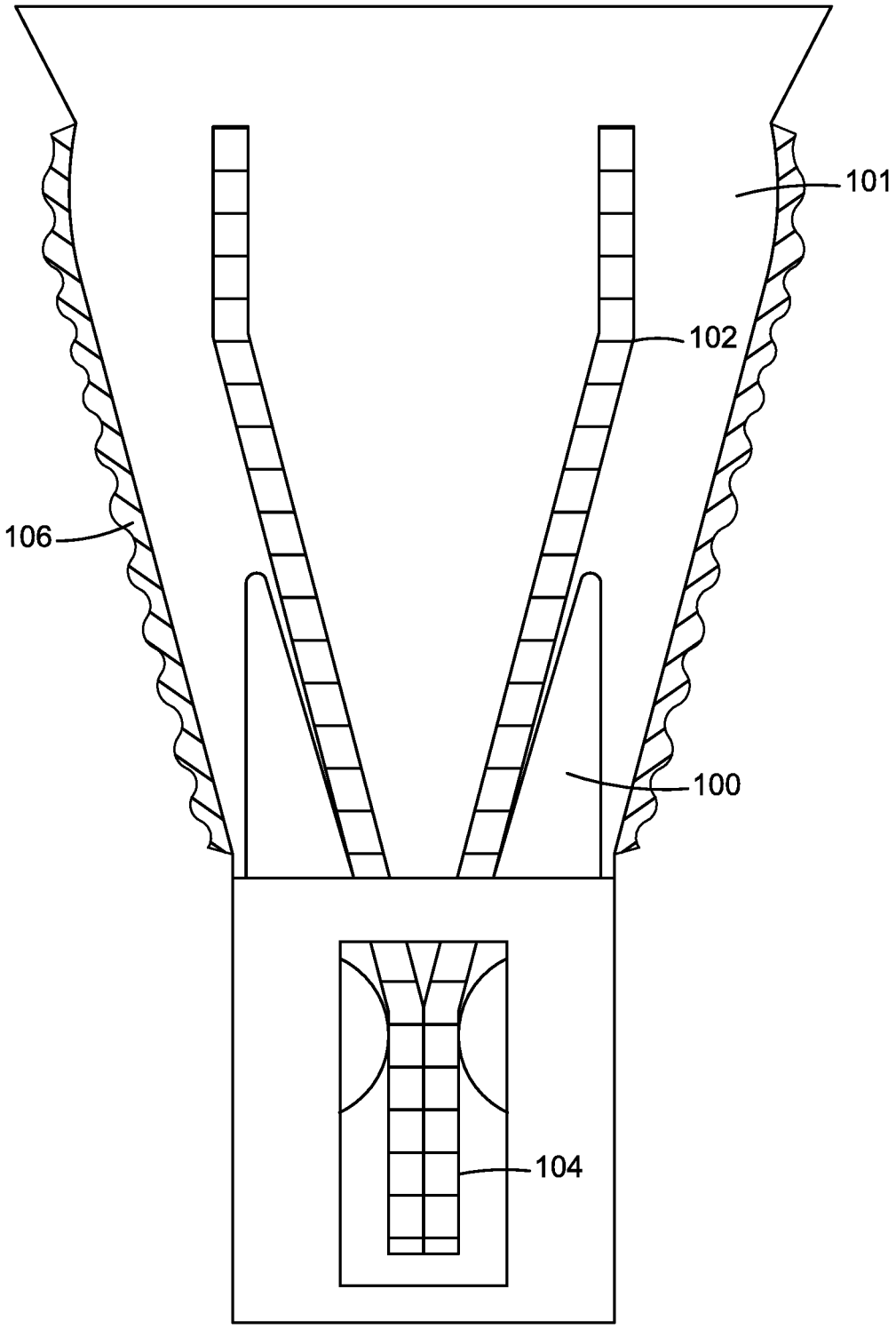
FIG. 16 depicts a preferred embodiment of a pouch and a base in which the base member has guides for guiding the pouch onto the base via grip strips positioned on the pouch.

FIG. 16 depicts an alternative embodiment of the pouch 101, and the base 103. The base 103 utilizes guides 105, 107, to guide the grip strips 102, 109, as the pouch is rolled downward into the base. The base in the depicted embodiment also provides guides 100, 100*b*, to guide the grip strips further into the base. This provides a mechanism by which the pouch is more efficiently placed within the base. This provides a smoother rolling of the pouch downward into the base.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

The invention claimed is:

1. An apparatus for holding a foodstuff or beverage, said apparatus comprising:

a base, wherein said base comprises an outer wall and an inner structure, wherein said outer wall extends upward from a first end of said base to a second end of said base, wherein said second end of said base comprises an open end, wherein said inner structure extends from said first end of said base toward said second end of said base, wherein said inner structure and said outer wall are separated by an air gap surrounding said inner structure, wherein said air gap is configured for the passage of an exterior wall of a pouch; and a pouch, wherein said pouch is configure to retain a foodstuff or beverage within said pouch, wherein said pouch is configured to be supported on said base when said pouch is retaining a foodstuff or beverage, wherein said pouch comprises an exterior wall configured to retain said foodstuff or beverage, wherein said exterior wall of said pouch is configured to roll or slide between said inner structure and said outer wall of said base such that as a user depletes the level of foodstuff or beverage within said pouch, said pouch is configured to be rolled or slid through said air gap into said base to retain a level of foodstuff or beverage within said pouch proximate to an opening of said pouch.

2. The apparatus of claim 1, wherein said pouch comprises a sealed pouch holding a foodstuff and/or beverage.

3. The apparatus of claim 1, wherein said pouch comprises a resealable pouch.

4. The apparatus of claim 1, wherein said pouch comprises at least one gripping structure on an exterior of said pouch.

5. The apparatus of claim 1, wherein said pouch comprises at least two compartments.

6. The apparatus of claim 5, wherein said compartments are separated by a releasable membrane.

7. The apparatus of claim 5, wherein said compartments are separated by a resealable membrane.

8. The apparatus of claim 7, wherein said resealable membrane comprises a membrane having a resealable zip-lock mechanism.

9. The apparatus of claim 1, wherein said base comprises a generally cylindrical shape.

10. A apparatus for holding a foodstuff or beverage, said apparatus comprising:

a base, wherein said base comprises a generally cylindrical shape having a side wall comprising a circumference of said generally cylindrical shape, wherein said base comprises a first end and an inner structure extending from said first end, wherein said inner structure is configured to support a pouch, wherein said inner structure is separated from said cylinder wall by an air gap, wherein said inner structure is configured to allow for a pouch to slide between said inner structure and said side wall;

a pouch configured to hold a foodstuff, wherein said pouch is configured to be supported on said base when said pouch contains a foodstuff; wherein said pouch is configured to roll or slide into said base between said inner structure and said side wall.

11. The apparatus of claim 10, wherein said pouch comprises at least one gripping structure on an exterior of said pouch.

12. The apparatus of claim 11, wherein said membrane comprises a liquid impermeable membrane.

13. The apparatus of claim 10, wherein said pouch comprises at least two compartments separated by a membrane.

14. The apparatus of claim 13, wherein at least two of said compartments are separated by a releasable membrane.

15. The apparatus of claim 14, wherein said pouch comprises a tear strip attached to said membrane and configured for a user to apply force to said tear strip to remove said membrane.

16. The apparatus of claim 13, wherein said at two of said compartments are separated by a membrane comprises a resealable membrane.

17. The apparatus of claim 10, wherein said pouch comprises a resealable opening.

18. The apparatus of claim 10, wherein said cylinder wall comprises openings configured to allow for a user's fingers to slide a pouch into said base through said air gap.

19. The apparatus of claim 10, wherein said projection comprises a rounded projection, wherein said rounded projection comprises a generally round shape having a circumference generally concentric with said cylinder wall.

20. The apparatus of claim 10, wherein said base comprises a space between said first end and said projection configure for receiving said exterior wall of said pouch after it travels through said air gap.

* * * * *